United States Patent [19]

Wilkinson

[11] Patent Number: 4,993,706

[45] Date of Patent: Feb. 19, 1991

[54] EXERCISE BENCH

[75] Inventor: William T. Wilkinson, Seaford, Del.

[73] Assignee: Super Step, Inc., Seaford, Del.

[21] Appl. No.: 450,172

[22] Filed: Dec. 13, 1989

[51] Int. Cl.[5] ..... A63B 1/00; A47B 3/02

[52] U.S. Cl. ..... 272/144; 272/70; 248/421; 108/117

[58] Field of Search ..... 248/188.2, 188.6, 439; 108/119, 120, 130, 132, 144; 272/144, 93, 96, 134, 138

[56] References Cited

U.S. PATENT DOCUMENTS

| | | | |
|---|---|---|---|
| 316,363 | 4/1985 | Hough | 248/421 |
| 2,172,609 | 9/1939 | Fogg | 248/421 |
| 3,653,715 | 4/1972 | Drabert et al. | 108/144 |
| 4,273,306 | 6/1981 | Chang | 108/145 |
| 4,296,694 | 10/1981 | Kobayashi | 248/421 |
| 4,384,533 | 5/1983 | Lehrman | 108/117 |

*Primary Examiner*—Stephen R. Crow

*Attorney, Agent, or Firm*—Connolly & Hutz

[57] ABSTRACT

An exercising bench includes a horizontal platform mounted on a plurality of support units which engage racks suspended from the platform for adjusting the elevation of the platform. The support units each have a pair of inner legs and a pair of outer legs pivotally connected together. The outer legs are pivotally and fixedly connected to the platform and the inner legs have a bridging member connected therebetween which engages the suspended racks to permit height and angular orientation adjustment of the platform relative to the ground.

10 Claims, 2 Drawing Sheets

EXERCISE BENCH

BACKGROUND OF THE INVENTION

My U.S. Pat. Nos. 4,340,218; 4,561,652; 4,648,593; 4,659,075 and 4,715,296 disclose exercising devices and techniques for the exercise of simulating climbing. The climbing exercise has been found to provide aerobic benefits far superior to conventional exercise such as jogging, swimming and cycling. Such exercising devices represent distinct improvements over prior commercially available climbing simulating devices which are of complicated construction thereby resulting int eh devices being expensive as well as relatively unsafe. A further prior art device is Garrett U.S. Pat. No. 3,743,283. The Garrett device, however, is somewhat complicated in operation in that it includes a plurality of steps wherein different elevations are achieved by moving individual steps to an inactive position. Other prior art includes U.S. Pat. Nos. 4,273,306; 4,384,533; 4,319,747 and 2,676,015.

It would be desirable if a device could be provided which overcomes the disadvantages of such prior devices by permitting the convenient simulation of climbing as in the aforenoted applications and which in addition lends itself for performing other exercises such as sit-ups or leg strengthening exercises.

SUMMARY OF THE INVENTION

An object of this invention is to provide an exercising device which is particularly suited for permitting the user to simulate climbing.

A further object of this invention is to provide such an exercising device which may also be used for performing other exercises.

A still further object of this invention is to provide such a device which is economical to manufacture and which can be conveniently stored, transported and assembled which is safe in operation.

In accordance with this invention, the exercising device is int he form of a bench comprising a horizontal platform mounted on adjustable support units. The platform has horizontal racks suspended therefrom to which legs of the support units are adjustably connected so as to permit the elevation of the bench to be varied.

THE DRAWINGS

DETAILED DESCRIPTION

Figure 2:
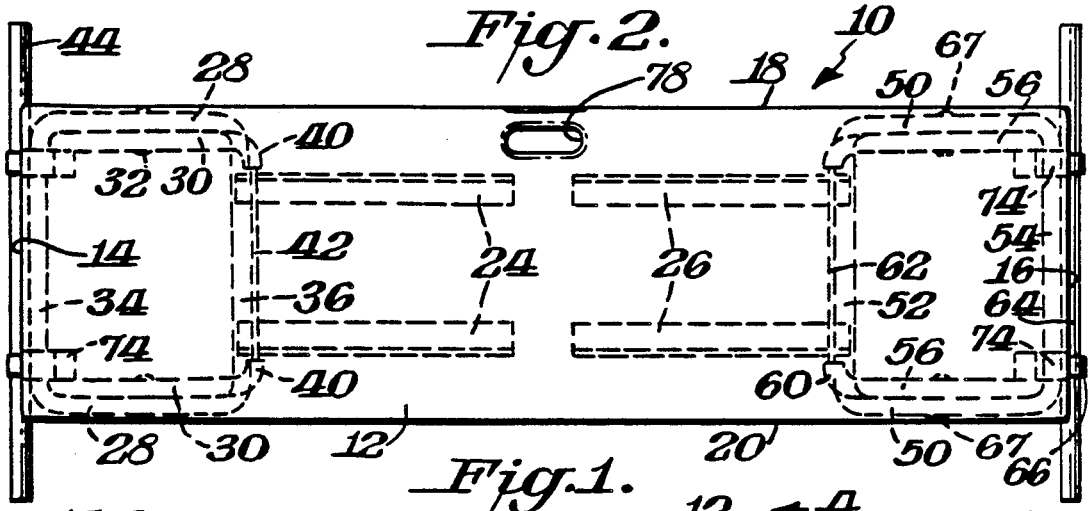
FIG. 2 is a top plan view of the exercise bench shown in FIG. 1.

FIGS. 1-4 show an exercise bench 10 in accordance with this invention. As shown in the drawings, bench 10 includes an elongated horizontal platform 12 which has a pair of opposite end portions 14, 16 and an intermediate pair of opposite side portions 18, 20. Each of the end portions joins a respective side portion at a corner of the platform.

Figure 1:
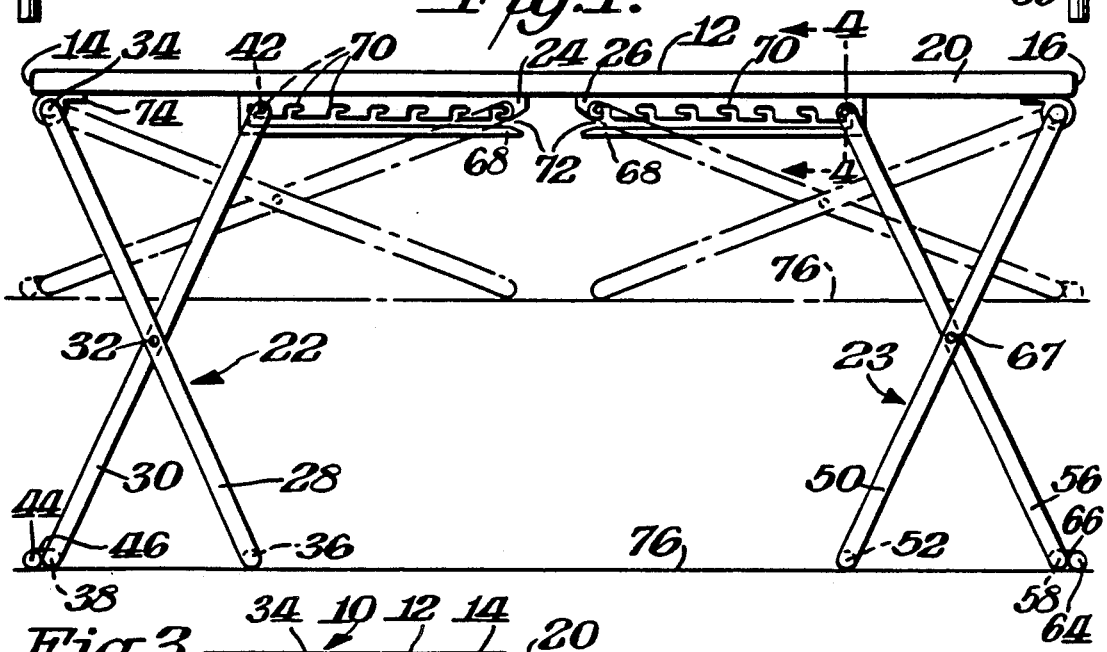
FIG. 1 is a side elevation view of an exercise bench in accordance with this invention.
Figure 3:
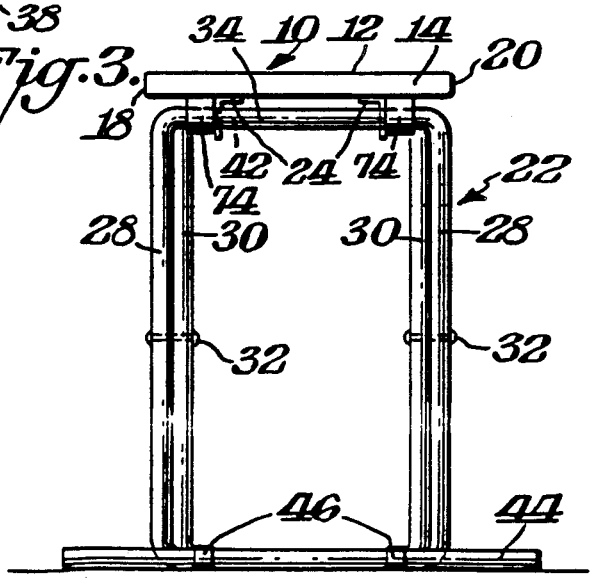
FIG. 3 is an end elevation view of the exercising bench shown in FIGS. 1-2.
Figure 4:
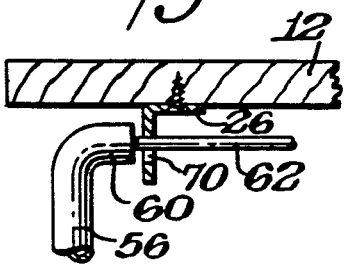
FIG. 4 is a cross-sectional view taken through FIG. 1 along the line 4—4.

Platform 18 is mounted on a plurality of support units 22, 23. Bench 10 achieves its adjustability by maintaining platform 12 fixed and manipulating support units 22, 23. As best shown in FIG. 1, a number of racks 24, 26 are suspendedly mounted from the bottom surface of platform 12 in a horizontal position. FIG. 2 illustrates a pair of racks 24, 24 and a second pair of racks 26, 26 to be provided with the racks of each pair operating in conjunction with each other.

As illustrated in the drawings, each support unit includes a pair of outer legs 28 and a pair of inner legs 30. Legs 28, 30 are formed form tubing material. In the preferred embodiment of the invention, outer legs 28 are integral with each other by bending the tubing int eh form of a rectangle which includes outer legs 28, upper bridging member 34 and lower bridging member 36. Similarly, inner legs 30 are integral with each other by having the tubing also generally rectangularly formed or more accurately generally U-shaped int hat inner legs 30 include a horizontal portion 38 connecting the lower ends of the inner legs while the upper ends of inner legs 30 bend inwardly to form extensions 40.

In order to provide added stability, a stabilizing member 44 may be located juxtaposed horizontal member 38 of inner legs 30 with stabilizing member 44 and lower portion 38 connected together by any suitable means such as spring clips 46.

Each pair of legs 28, 30 is pivotally secured together by means of pin 32.

Support unit 23 is formed identically with support unit 22. Thus support unit 23 includes outer legs 50 interconnected by upper bridging member 54 and lower bridging member 52. Similarly, support unit 23 includes inner legs 56 interconnected by lower bridging member 58 with the inner legs 56 terminating at the upper ends in inwardly directed portions 60 which are spanned by rod 62. A stabilizing member 64 is secured to lower bridging member 58 by spring clips 66. Each pair of inner leg 56 and outer leg 50 is connected together by pin 67.

As illustrated, each rack 24, 26 includes a plate having a lower flange o cantilevered extension 68 and a plurality of L-shaped notches or slots 70 which communicate with the elongated slot 72 formed between flange or cantilevered extension 68 and the main portion of the rack 24 or 26. Rod 42 travels int eh slot 72 of rack 24 while rod 62 travels in its slot 72 of rack 26. By proper selection of the notch or cut-out 70 or rods 42 and 62, the angulation of inner legs 30 and 56 is controlled. Outer legs 28, 50 are pivotally connected to platform 12, freely rotating in bearing members or collars 74 mounted to the bottom of platform 12. Thus when the angulation of inner legs 30 and 56 is changed, a corresponding pivotal action of outer legs 28 and 50 is also accomplished. As a result, the elevation of platform 12 above the supporting surface 76 may be adjusted. FIG. 1, for example, shows in full lines an extreme position wherein platform 12 is the maximum height above surface 76. FIG. 1 also shows in phantom where platform 12 is the minimum height above surface 76. It is noted that for the sake of clarity of illustration, FIG. 1 appears to show surface 76 being elevated. In fact, of course, surface 76 is stationary, and platform 12 is lowered.

As shown in FIG. 1, each support unit may be individually adjusted to thereby alter the angular orientation of the platform relative to the surface 76.

Bench 10 is particularly suited for the exercise of simulating climbing as described in the above-noted parent application. In operation, the user would place bench 10 on a suitable support surface 76 and would select the desired elevation for platform 12 by appropriately locating rods 42 and 62 in the proper slots or notches 70 of racks 24 and 26. If any adjustment is necessary, the rod is simply moved out of its perspective notch 70 and is confined in slots 72 until the desired notch 70 is reached whereas the rods would then be moved into those notches to thereby control the elevation of platform 12. The climbing exercise could be enhanced by the user wearing or carrying weights to provide the ideal aerobic exercise.

For purposes of storage and transportation, exercise bench 10 could be disassembled into the individual components comprising platform 12 to which racks 24, 26 would be permanently secured and also comprising the sets of legs forming support units 22, 23 and finally the stabilizing members 44, 64. Platform 12 is provided with an opening 78 which would serve as a convenient handle. Advantageously bench 10 may be stored or transported by folding the legs of support units 22, 23 directly against platform 12. By having flanges 68 cantilevered, slots 72 are open whereby rods 42, 62 may be completely withdrawn from slots 72 to permit bench 10 to be completely flat in its inactive position.

Although the parent application describes a simulated climbing device in the form of a step, device 10 may be better considered as a bench since it is of larger dimension than the ordinary connotation attributed to a step. For example, platform 12 might be 40 inches long and 11 ¼ inches wide. Platform 12 could have 7 positions of adjustment providing a range of elevation from 8 inches to 20 inches. Any suitable materials may be used for making the various components of exercise bench 10. The legs of the support units could be ¾ inch steel tubing. It is within the concepts of this invention that the various legs be distinct from each other by simply being separate members which may include or may omit bridging members to join them together. The use of tubing bent rectangularly to result in the respective pairs of legs being integral with each other has the advantages of ease of manufacture and assembly as well as increasing stability.

A further advantage of forming device 10 as a bench rather than a step is that it lends itself to other types of exercise. For example, the user may lay on platform 12 and do such exercises such as sit-ups. In such instances, platform 12 may be provided with a padded top to give added comfort. Exercise bench 10 may also be used for various exercises which would involve the user bending his legs at the knee such as in leg strengthening exercises wherein weights would be provided at the ankles. With such exercises the elevation adjustability feature of bench 10 is particularly desirable since it permits platform 12 to be elevated the appropriate amount in connection with the length of the user's legs.

As can be appreciated, bench 10 thus provides an exercising device which is not only suitable for its primary purpose of simulating climbing but also serves as a convenient device for performing other exercises.

Figure 6:
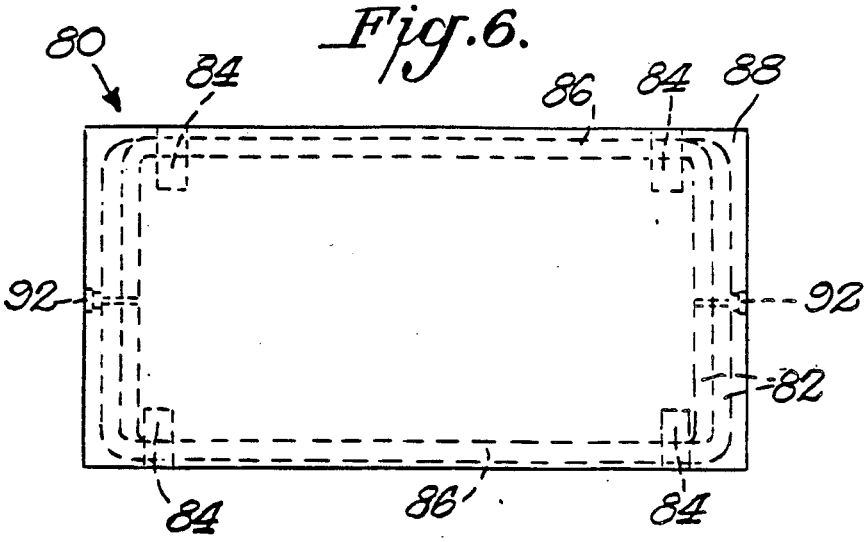
FIG. 6 is a top plan view of the embodiment of FIG. 5.
Figure 5:
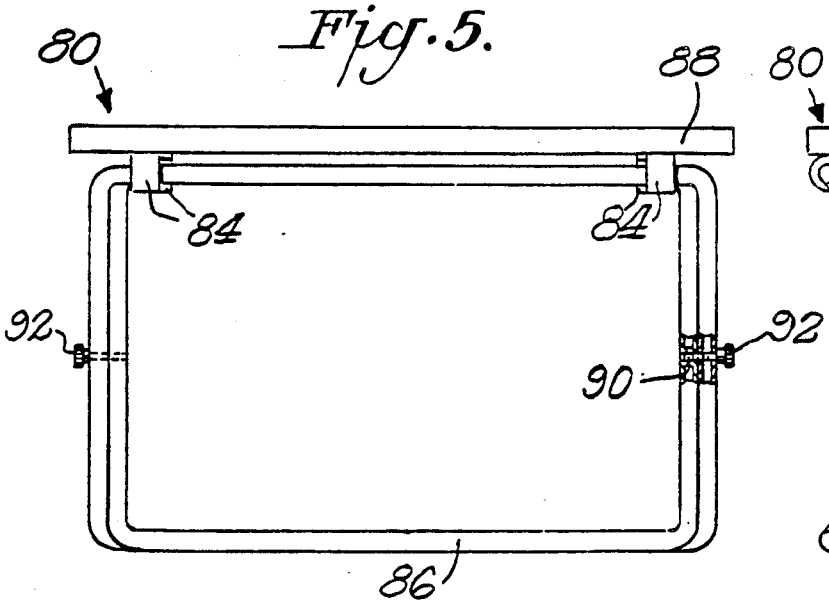
FIG. 5 is a front elevation view of a further embodiment of this invention.
Figure 7:
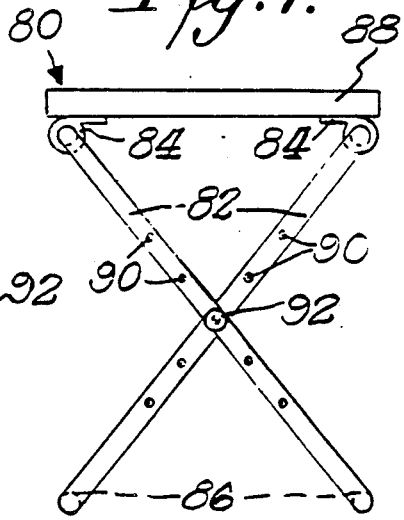
FIG. 7 is a side elevation view of the embodiment of FIGS. 5-6.

FIGS. 5–7 show a further embodiment wherein the bench 80 has a pair of cross legs 82 at each end thereof. Legs 82 are pivoted in brackets 84 and include support extensions 86 at their opposite ends. The elevation of platform 88 is adjusted by providing sets of holes 90 in legs 82 whereby the angle of the cross legs is adjustably fixed by detachable fasteners 92 is sets of holes 90. The elevation of platform 88 is thus selected in accordance with the set of holes 90 selected. If desired, support extensions 86 may be detachably connected to legs 82. Alternatively support extensions 86 may be integral with legs 82 whereby a leg from each set is connected by an extension at each end of the leg to a corresponding leg of the other set to form two closed loop rectangles of tubular structure.

What is claimed is:

1. An exercise bench comprising an elongated horizontal platform having a pair of opposite end portions and an intermediate pair of opposite side portions, each of said end portions joining a respective side portion at a corner of said platform, said platform being mounted on a plurality of support units comprising a pair of support units at each of said end portions, two sets of parallel racks having a series of cutouts and suspendedly mounted from said platform in a horizontal position, each of said support units comprising a pair of inner legs and a pair of outer legs pivotally connected together, the upper end of each of said outer legs being pivotally and fixedly connected to said platform, the upper end of each of said inner legs being adjustably engaged to one of said rack in such a manner that the distance between the ends of said legs may be varied to vary the overall height of said support unit to thereby provide a means for adjusting the degree of elevation and angular orientation of said platform whereby said platform may be used for a climbing exercise program to permit the user to step up on to and to step down from said platform, a bridging member connecting said upper ends of each pair of said inner legs of said support units, and said bridging member engaging a corresponding pair of said racks.

2. The exercise bench of claim 1 wherein said pair of outer legs of each of said support units is formed from tubing bent into rectangular shape with opposite sides of said tubing comprising said outer legs.

3. The exercise bench of claim 2 wherein each pair of said inner legs of each of said support units is formed of tubing bent into U-shape with the open end of said U being at the upper end of said legs, and said bridging member spanning the open end of the U.

4. The exercise bench of claim 3 including a horizontally disposed stabilizing member connected to each of said support units.

5. The exercise bench of claim 4 wherein said stabilizing member is juxtaposed and detachably connected to the corresponding horizontal portion of the tubing joining said inner legs.

6. The exercise bench of claim 5 wherein each of said racks comprises a plate having a series of inverted L-shaped cut-outs.

7. The exercise bench of claim 6 wherein said racks include a cantilevered extension located below and spaced from said cut-outs.

8. The exercise bench of claim 7 wherein an opening is formed in said platform to provide a carrying handle.

9. The exercise bench of claim 7 wherein said platform is about 40 inches long and 11 ¼ inches wide, said support units permitting said platform to be elevated in a number of selected positions between 8 inches and 20 inches above a support surface.

10. The exercise bench of claim 7 wherein said support units may be folded flat against said platform to facilitate storage and transportation of said bench.

* * * * *